US005690006A

United States Patent [19]

Pulliam

[11] Patent Number: 5,690,006

[45] Date of Patent: Nov. 25, 1997

[54] INFINITELY SLIDE-ADJUSTABLE SOCKET EXTENDER FOR SOCKET WRENCHES

[76] Inventor: Doyle H. Pulliam, P.O. Box 234, Horatio, Ark. 71842

[21] Appl. No.: 651,946

[22] Filed: May 21, 1996

[51] Int. Cl.[6] ..... B25B 23/16

[52] U.S. Cl. ..... 81/177.2; 403/326

[58] Field of Search ..... 87/177.2; 403/324, 403/326, 377–379

[56] References Cited

U.S. PATENT DOCUMENTS

| | | | |
|---|---|---|---|
| 3,227,015 | 1/1966 | Tremblay | 81/177.2 |
| 3,289,503 | 12/1966 | Klatt | 81/177.2 X |
| 5,033,337 | 7/1991 | Thomas, III . | |
| 5,109,737 | 5/1992 | Raber . | |
| 5,138,911 | 8/1992 | Lan . | |
| 5,193,419 | 3/1993 | Lee . | |
| 5,285,702 | 2/1994 | Hillinger . | |
| 5,289,745 | 3/1994 | Beardsly . | |
| 5,363,727 | 11/1994 | Barth et al. . | |

FOREIGN PATENT DOCUMENTS

| | | |
|---|---|---|
| 1186923 | 5/1985 | Canada . |
| 0 191 913 | 8/1986 | European Pat. Off. . |

*Primary Examiner*—James G. Smith
*Attorney, Agent, or Firm*—Richard C. Litman

[57] ABSTRACT

A telescopic extender for extending an interchangeable socket of a socket wrench, more particularly, an extender which automatically, slidably and continuously adjusts its length by infinitely small increments for use during a ratcheting operation confined to an inaccessible space between two fixed walls. The extender includes a tubular member, a pair of axially extending slots defined by the wall of the tubular member, a shaft member having a first end slidably extending into the tubular member and a second end extending out of the tubular member provided for receiving the socket, the second end adapted to the receive a socket. The shaft member is further provided with at least one protruding member extending into each of the axially extending slots, which combination permits slidable retention of the shaft within the tubular member. The protruding member is a removable pin which is passed entirely through a bore in the shaft member and into the two slots. A biasing means such as a coil spring is disposed between the closed end portion and the first end of the shaft member within the tubular member. The coil spring is a predetermined length up to substantially the full length of the chamber of the tubular member such that an outward bias can be applied at a point when the spring is compressed by the shaft member within the tubular member.

4 Claims, 4 Drawing Sheets

INFINITELY SLIDE-ADJUSTABLE SOCKET EXTENDER FOR SOCKET WRENCHES

BACKGROUND OF THE INVENTION

1. Field of the Invention

The present invention relates to a telescopic extender for extending an interchangeable socket of a socket wrench, more particularly, an extender which automatically, slidably and continuously adjusts its length by infinitely small increments for use during a ratcheting operation in a confined space between two fixed walls.

2. Description of the Prior Art

Telescopic extenders for socket and ratchet wrenches are well known in the prior art. A socket wrench combines an offset handle with a male drive piece having a spring-loaded bearing lock on various sized sockets. A ratchet wrench is a socket wrench having a ratchet mechanism which controls the direction of applied torque. The use of an extender with a socket wrench is sometimes necessary when encountering confined spaces.

Exemplary of a simple but confined configuration, the receiving wall and bolt are typically accessible in a direct line of sight, yet restricted by a narrow channel thus preventing application of the socket to the bolt or nut except by use of an extension means. In this situation, many of the prior art devices may be useful to provide a simple means of extending the socket to the desired length, locking or positioning the extender means at such length, and applying torque to a properly positioned socket and wrench. Even a simple type of non-variable length extension could be used as shown in U.S. Pat. No. 5,289,745 issued Mar. 1, 1994 to Beardsly.

However, no feature is known which allows an extender tool to be adjusted in length continuously during a torquing operation in combination with either type wrench. Typically, a need for a continuously adjustable extender tool arises where the direct removal of a torqued object, such as a bolt, nut, sparkplug, or other usually threaded object, is blocked and inaccessible to direct placement of a socket onto the torqued object except through a restricted opening lateral to the torqued object. In other words, the torqued object is positioned on one of two opposing walls and is further confined by a side wall, thereby defining a space accessible only through a side wall opening. A similar configuration can be appreciated from FIG. 3 herein described later.

Thus if the removal of a threaded bolt from its matingly threaded hole in one of such two opposing walls is desired, a socket and extender may be passed into such side wall opening and properly placed onto the bolt head, whereby a right angle is usually formed by the bolt, socket and extender relative to the socket wrench handle. The handle may be further limited in rotation by the side wall. As the torquing operation begins, the handle of the ratchet wrench is rotated about the socket and extension, thus slowly removing the bolt from its receiving wall. However, as the bolt is removed, the distance between the bolt head (and the attached tool) and the fixed wall opposing the bolt decreases, and continues to decrease as the operation progresses. If the combination of the socket, extender, and socket wrench are of a fixed length, the likelihood exists that the fixed length of such combination is longer than the available space between the fixed opposing wall and the head of the bolt at any point during the operation before the threaded shaft of the bolt is completely removed. Therefore, one runs out of room to remove the bolt by causing the wrench to abut against the opposing wall. If so, the operation is impeded or prevented altogether because the shaft of the bolt remains in the hole and the tool cannot be further rotated.

At a very minimum, the wrench assembly must then be torqued in a reverse direction to provide sufficient room for removal of the wrench assembly from the confined space, whereupon the extender, if variable in length, is manually adjusted, or replaced with a shorter wrench extender. The following patents describe inventions which provide a variable length extender, but fail to provide a mechanism by which the tool can continue to properly function under the above described constraints. For example, U.S. Pat. No. 5,138,911 issued Aug. 18, 1992 to Lan describes a telescopic wrench extender including a tubular member with a closed end portion adapted to engage a socket wrench and a shaft member which is slidably inserted into the tubular member. Critically, however, the shaft member is maintained at a selected position by a fastening pin which is engaged by a releasable press member. The disadvantage of the Lan invention as directed to the above described configuration and removal of a bolt is the need to intermittently remove the tool from the confined space and readjust the length of the extender. Moreover, if the press member of the Lan patent is not engaged, it appears that the shaft member is free to randomly float longitudinally within tube, possibly causing disengagement of the extender from the bolt head.

Likewise, U.S. Pat. No. 5,033,337 issued Jul. 23, 1991 to Thomas, III describes an extension unit having an extension arm or shaft member employing spring-loaded balls to engage the wall of a tubular member at predetermined points. Engagement is secured by a thumb latch. The same disadvantages as seen in the Lan patent are inherent to the '337 invention.

Although patents for extensible socket wrench handles describe structures which may resemble that of socket extenders, these patents teach away from the field of socket extenders and the present invention because they are each intended to provide increased leverage of the wrench and hence greater applied torque. None describe means adapted to extend the handle similar to any socket extender or teach that such the handles are variably adjustable during use in particularly cramped quarters. For example, Canadian Patent No. 1,186,923 issued May 14, 1985 to Johnston et al. describes a telescopic tool handle which slidably extends but spring locks only in a fully extended position. U.S. Pat. No. 5,109,737 issued May 5, 1992 to Raber describes a slidable tool handle which extension is dependent upon manually positioning a sleeve over one of a series of prepositioned holes and then adjusting a locking screw provided on the handle. U.S. Pat. No. 5,193,419 issued Mar. 16, 1993 to Lee also describes a slidable tool handle which extension is dependent upon manually positioning a sleeve over one of a series of prepositioned circumferential channels on the handle and securing it by a locking bolt. U.S. Pat. No. 5,285,702 issued Feb. 15, 1994 to Hillinger describes an extendible handle relying on a threaded internal bushing. U.S. Pat. No. 5,363,727 issued Nov. 15, 1994 to Barth et al. describes a telescopic handle having at least one radially inwardly extending projection on a locking to prevent relative movement in a lock position until manually released. None of these inventions suggest means by which, during a torquing operation resulting in a decreasing relative distance between the torqued object and a fixed wall, the removal of the torqued object is accomplished.

In the interest of the inventor's duty of disclosure, European Patent publication No. 0 191 913 published Aug. 27, 1986 by inventor Eckel illustrates an interchangeable set of heads and mating wrench handle.

None of the above inventions and patents, taken either singly or in combination, is seen to describe the instant invention as claimed.

SUMMARY OF THE INVENTION

The present invention relates to a telescopic extender for extending an interchangeable socket of a socket wrench, more particularly, an extender which automatically, slidably and continuously adjusts its length by infinitely small increments for use during a ratcheting operation confined to an inaccessible space between two fixed walls. The extender includes a tubular member having an open end and an opposite closed end portion. The closed end portion defines a polygonal axial recess for closely accepting a matingly configured male drive member of the wrench. A pair of axially extending slots and are disposed on opposite sides along the longitudinal axis of the extender between the open end and the closed end portion.

The extender further includes a shaft member having a first end slidably extending into the tubular member and a second end extending out of the tubular member and adapted to the receive a socket. The shaft member is further provided with at least one protruding member extending into each of the axially extending slots to provide slidable retention of the shaft within the tubular member. The protruding member is a removable pin which is passed entirely through a bore in the shaft member and into the two slots.

Finally, a biasing means, such as a coil spring, is disposed between the closed end portion and the first end of the shaft member within the tubular member. The coil spring is a predetermined length up to substantially the full length of the chamber of the tubular member such that an outward bias can be applied at a point when the spring is compressed by the shaft member within the tubular member.

Accordingly, it is a principal object of the invention to provide an extender means for use with a socket wrench for removing a torqued object from a fixed receiving wall which is confined by an opposing wall at a fixed distance.

It is another object of the invention to provide an extender for socket wrenches which is infinitely incrementally adjustable within a finite length between two points.

It is a further object of the invention to provide a slidably adjustable extender for socket wrenches which is continuously and automatically adjusted during the torquing operation.

Still another object of the invention is to provide an adjustable extender for socket wrenches which avoids the need to be intermittently adjusted during any torquing operation.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
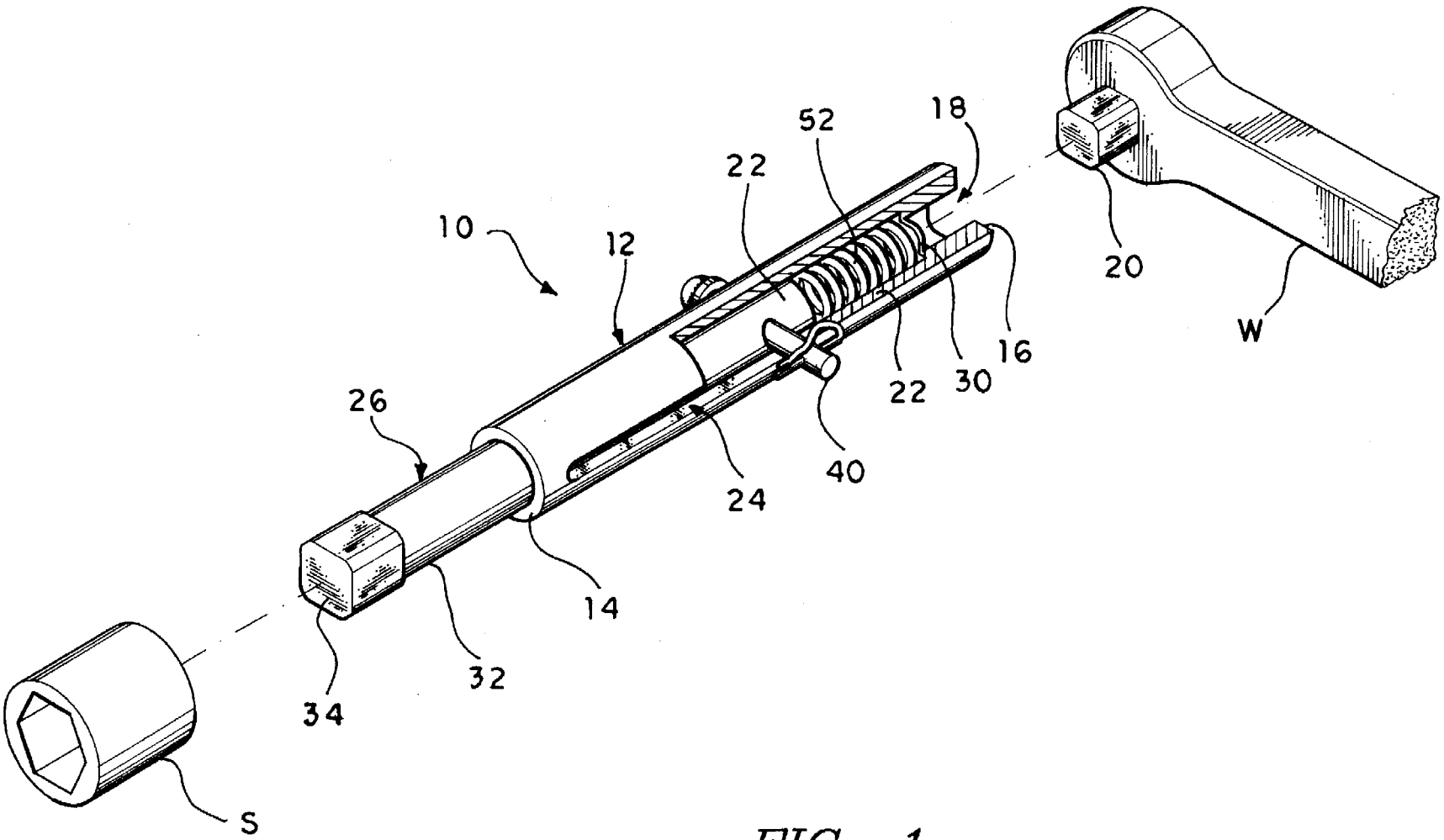
FIG. 1 is an partially fragmented environmental perspective view of the extender for use with a socket wrench.

The present invention relates to a telescopic extender for extending an interchangeable socket of a socket wrench, more particularly, an extender which automatically, slidably and continuously adjusts its length by infinitely small increments for use during a ratcheting operation confined to an inaccessible space between two fixed walls. Referring to FIG. 1, the preferred embodiment of the extender 10 is shown in combination with a socket wrench W (having a partially fragmented handle) and socket S. The extender 10 is positioned for use, in a conventional manner, between the socket S and the wrench W.

The extender first includes a tubular member 12 having an open end 14 and an opposite closed end portion 16, shown having a cylindrical outer wall 22 of the tubular member 12 partially broken away for clarity of illustration. The closed end portion 16 defines a polygonal axial recess 18 for closely accepting a matingly configured male drive member 20 of the wrench W. The recess 18 is defined by wall 22 and septum 30 of the closed end portion 16, the septum 30 separating the recess 18 from the chamber accessed by the open end 14. Such recess may be further adapted to have a depression (not shown) for accepting a spring-loaded ball lock as commonly found on ratchet and socket wrenches.

An axially extending slot 24 is further defined by the wall 22 and is disposed along the longitudinal axis of the extender 10 between the open end 14 and the closed end portion 16. A second identical slot 24 (not shown) is provided on a radially opposite side of the wall 22 to provide through passage of a pin 40 or other protruding member.

Next, the extender includes a shaft member 26 having a first end 28 slidably extending into the tubular member 12 and a second end 32 extending out of the tubular member 12 provided for receiving the socket S. The second end 32 is provided with a male member 34 being matingly configured to the receiving recess (not shown) of the socket S, usually polygonal in cross section. Again, it should be obvious that devices, such as a spring-loaded ball lock as commonly found to temporarily secure sockets to the drive member of a wrench, may be chosen from the prior art to further improve the extender. By including such device on the male member 34, a socket may be secured to the male member 34 in a conventional manner.

Figure 2:
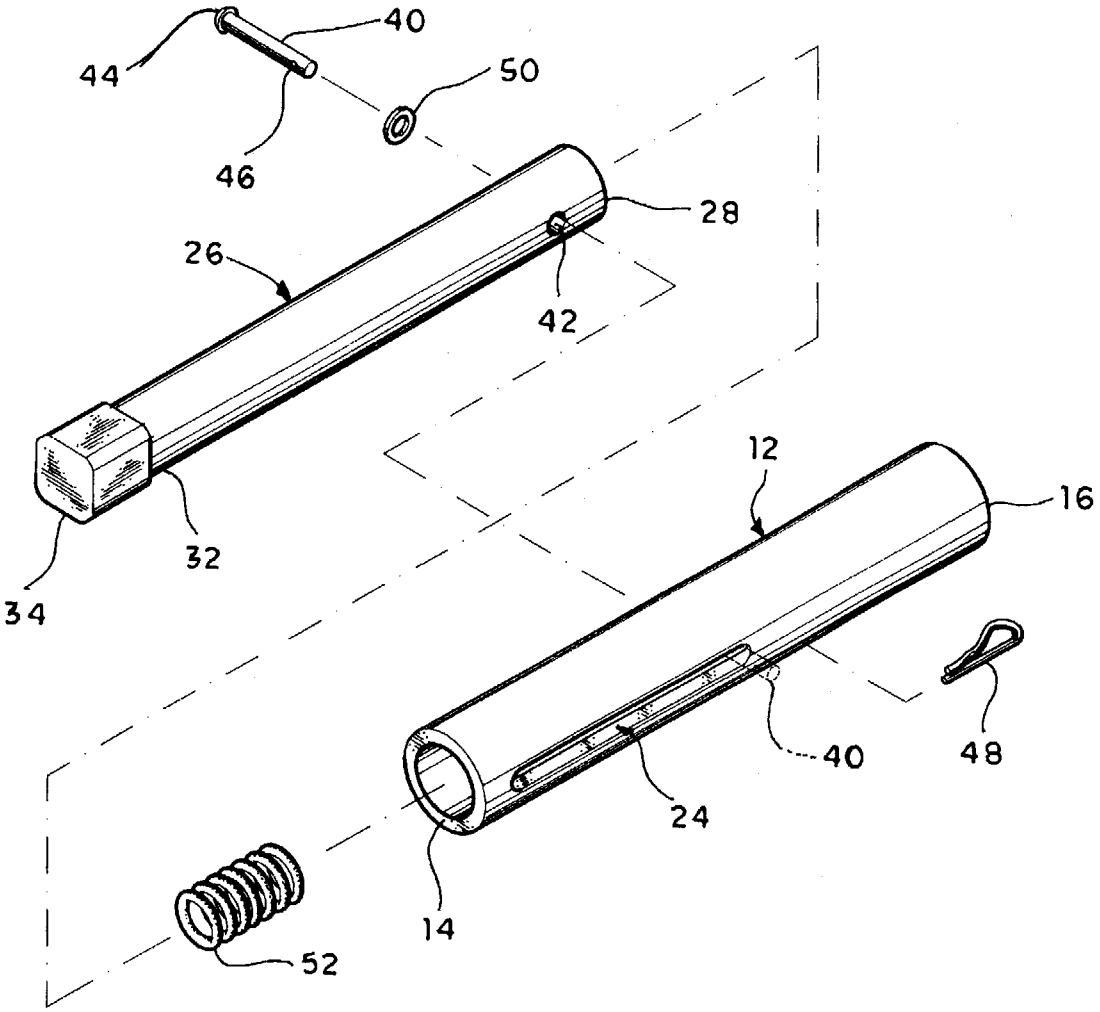
FIG. 2 is an exploded view of the extender for use with a socket wrench.

The shaft member 26 is further provided with at least one protruding member extending into the axially extending slot 24, which combination permits slidable retention of the shaft within the tubular member 12. Although various permanently affixed means can be envisioned to accomplish this concept (such as studs permanently protruding from the shaft), as can be best appreciated from FIG. 2, the preferred embodiment of the protruding member is a removable pin 40 which closely passes into a bore 42 which is defined radially through the shaft member 26 proximate to its first end 28. The bore 42 is provided to be in registry with slot 24 in the assembled extender 10 and the pin 40 has a predetermined length in substantial excess of at least the diameter of shaft member 26 to allow passage into slot 24 on each side of tubular member 12. Thus, after insertion of the first end 28 of the shaft member 26 into the open end 14 of the tubular member 12, the bore 42 can be aligned with each of the two slots 24 and the pin 40 may be passed entirely through the bore 42 into the two slots 24 thereby preventing the removal of shaft member 26 from the tubular member 26.

Preferably, the pin 40 extends laterally beyond each side of the tubular member 12 as well, such that a head 44 on one end of the pin 40 can be provided to prevent passage of the pin too far into slot 24 and through the bore 42. Likewise, a passage 46 for insertion of a cotter pin 48 can be provided to removably secure pin 40. Obviously, a threaded pin, cap nuts or other means, including a washer 50, may be used to secure the pin 40 in a removable manner and accomplish the above noted intended purpose of slidably retaining the shaft member 26 in the tubular member 12.

Finally, a biasing means, such as a coil spring 52, is disposed between the closed end portion 16 and the first end 28 of the shaft member 26. Such coil spring 52 is of a diameter slightly less than that of the diameter of the shaft member 26 such that the first end 28 is biased against the septum 30 of the tubular member 12. Thus, when the wrench is held in a fixed position and a force is applied to the socket S in the direction of the wrench W, the spring is compressed and exerts an opposing force in an opposing or outward axial direction, being the direction from the wrench W towards the socket S. The coil spring 52 may be of a predetermined length up to substantially the full length of the chamber of the tubular member 12, such that a minimum of outward bias would be applied at all times to the shaft member 26. However, as shown in each of the FIGURES, the spring 52 is of a relatively short length, thus allowing a greater degree of freely slidable movement of the shaft member 26 within the chamber of the tubular member 12 which may be preferable in circumstances wherein the extender 10 is to be used in the conventional manner.

Figure 3:
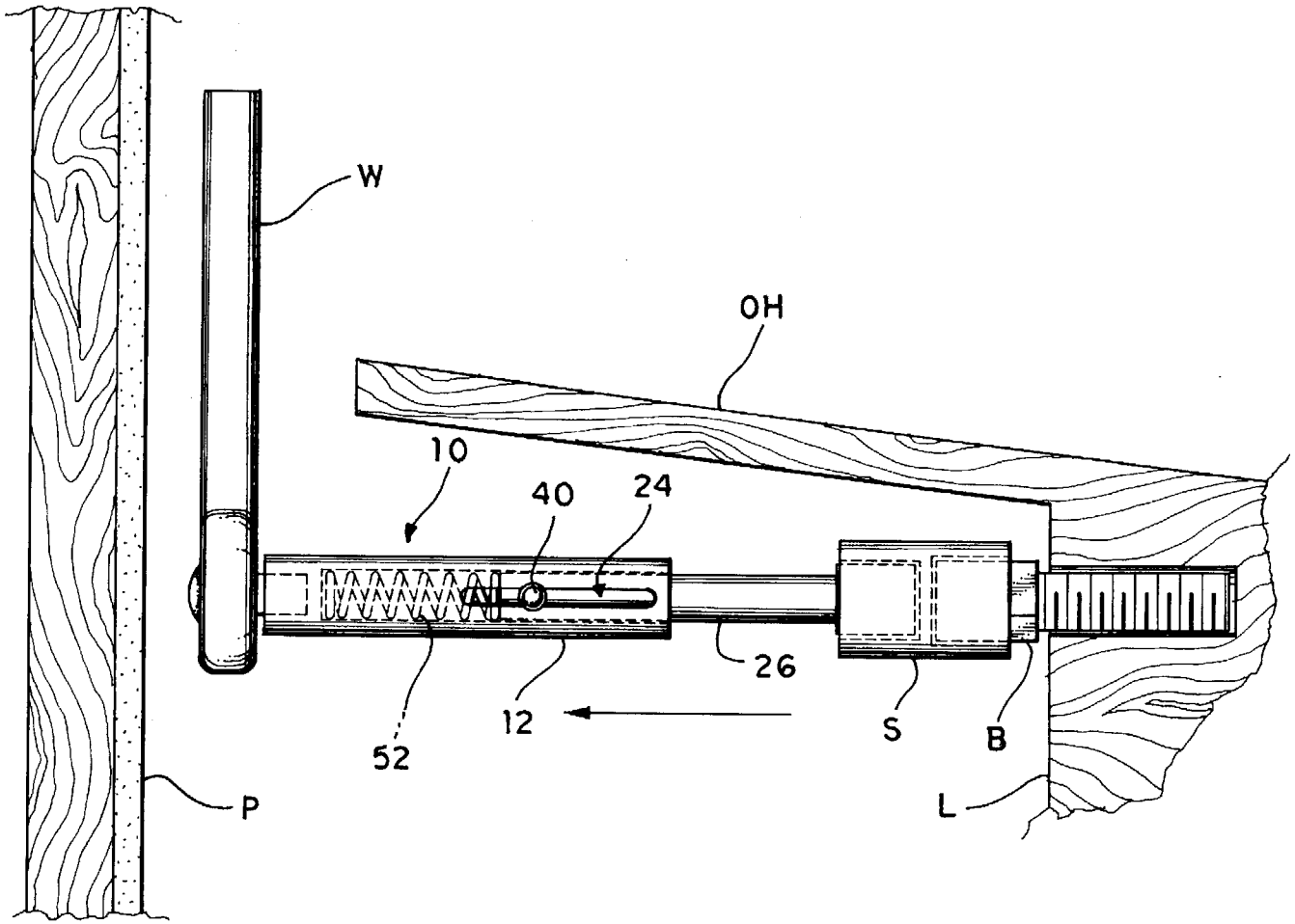
FIG. 3 is an environmental elevational view of the extender and socket wrench in a first relative state, attached to an object to be torqued within a confined space.
Figure 4:
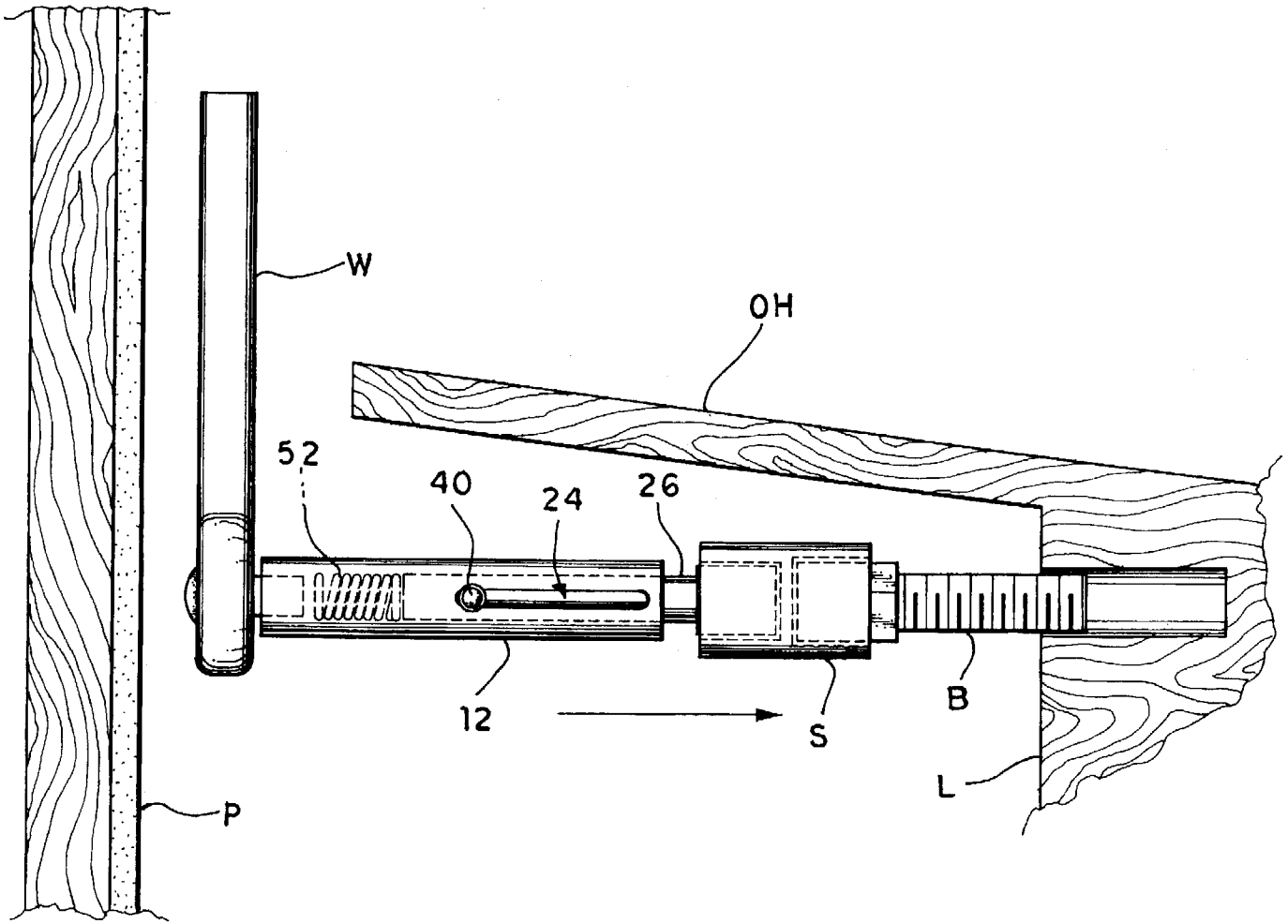
FIG. 4 is an environmental elevational view of the extender and socket wrench attached to an object to be torqued in a second relative state, attached to an object to be torqued within the same confined space as shown in FIG. 3.

The operation of the extender 10 is best understood by comparative reference to FIG. 3 and FIG. 4 showing two states of extraction of a threaded bolt B from a receiving wall L and obstructed by an opposing wall P and an overhanging wall OH. In FIG. 3, the socket S and extender 10 have been passed into the opening between the overhang OH and the opposing wall P and properly placed onto the head of the B. As can be observed, the handle of the wrench W is limited to rotation at a near distance of no less than that determined by the overhang OH, for which an extender is necessary to reach the bolt B. Similarly, the far distance is limited by the opposing wall P.

As the torquing operation begins, the handle of the ratchet wrench W is rotated about the socket S and extender 10, thus slowly removing the bolt B from its receiving wall n. However, as shown in FIG. 4, as the bolt B is removed, the relative distance between the bolt B (and the attached extender 10 and wrench W) and the opposing wall P is decreased. This decrease in distance is taken up by the compression of spring 52 thereby shortening the extender 10. As can be seen by comparing FIG. 3 and FIG. 4, the pin 40 and shaft member 26 have been retracted into the tubular member 12; the pin 40 tracks slot 24. As the torquing operation continues, the spring 52 continues compress as the distance between the bolt B and the opposing wall P is further decreased until the bolt B is removed. (It should be noted that although it appears that in FIG. 4 that the spring 52 is fully compressed, by moving the wrench W proximate to the opposing wall P, the torquing operation can be completed to remove the bolt B.)

It is to be understood that the present invention is not limited to the sole embodiment described above, but encompasses any and all embodiments within the scope of the following claims.

I claim:

1. A wrench socket extender, comprising:

a tubular member having an open end, an opposite closed end portion provided with a polygonal axial recess, two axially extending slots disposed between said open end and said closed end portion, each of said two axially extending slots disposed on radially opposite sides of said tubular member;

a shaft member having a first end slidably extending into said tubular member and a second end extending out of said tubular member and being provided with an axial male member being polygonal in cross section, said shaft member further having a radial bore proximate said first end with a removable pin passing through said bore and extending laterally beyond each of said two axially extending slots; and, biasing means for biasing said shaft member provided within said tubular member and disposed between said closed end portion and said first end.

2. The wrench socket extender according to claim 1, wherein said biasing means is a coil spring.

3. A wrench socket extender, comprising:

a tubular member having an open end, an opposite closed end portion provided with a polygonal axial recess, said tubular member including at least two axially extending slots disposed between said open end and said closed end portion, each of said at least two axially extending slots disposed on radially opposite sides of said tubular member;

a shaft member having a first end slidably extending into said tubular member and a second end extending out of said tubular member and being provided with an axial male member being polygonal in cross section, said shaft member including a radial bore passing through said shaft, said bore being proximate to said first end;

at least one removable protruding member passing into said bore and extending laterally beyond said shaft and through each one of said two axially extending slots; and, biasing means for biasing said shaft member provided within said tubular member and disposed between said closed end portion and said first end.

4. The wrench socket extender according to claim 3, wherein said biasing means is a coil spring.

* * * * *